US011465725B2

(12) United States Patent
Takase

(10) Patent No.: US 11,465,725 B2
(45) Date of Patent: Oct. 11, 2022

(54) MARINE PROPULSION UNIT AND MARINE VESSEL

(71) Applicant: YAMAHA HATSUDOKI KABUSHIKI KAISHA, Iwata (JP)

(72) Inventor: Hiroaki Takase, Shizuoka (JP)

(73) Assignee: YAMAHA HATSUDOKI KABUSHIKI KAISHA, Iwata (JP)

( * ) Notice: Subject to any disclaimer, the term of this patent is extended or adjusted under 35 U.S.C. 154(b) by 37 days.

(21) Appl. No.: 17/133,030

(22) Filed: Dec. 23, 2020

(65) Prior Publication Data

US 2021/0197944 A1 Jul. 1, 2021

(30) Foreign Application Priority Data

Dec. 26, 2019 (JP) ..... JP2019-236268

(51) Int. Cl.
*B63H 23/24* (2006.01)
*B63H 5/125* (2006.01)
*B63H 5/14* (2006.01)

(52) U.S. Cl.
CPC ..... *B63H 23/24* (2013.01); *B63H 5/125* (2013.01); *B63H 5/14* (2013.01); *B63H 2005/1258* (2013.01)

(58) Field of Classification Search
CPC ..... B63H 5/14; B63H 5/125; B63H 20/10; B63H 20/12; B63H 23/24; B63H 2005/1258
See application file for complete search history.

(56) References Cited

U.S. PATENT DOCUMENTS

2003/0186601 A1 10/2003 Collier et al.
2013/0115833 A1* 5/2013 Suzuki ..... B63H 5/14 440/2
2016/0059949 A1 3/2016 Rebele et al.
2019/0382090 A1 12/2019 Suzuki et al.

FOREIGN PATENT DOCUMENTS

EP 2591995 A1 * 5/2013 ..... B63H 21/14
EP 3569492 A1 * 11/2019 ..... B63H 20/06
WO 2017/082248 A1 5/2017

* cited by examiner

*Primary Examiner* — Stephen P Avila
(74) *Attorney, Agent, or Firm* — Rabin & Berdo, P.C.

(57) ABSTRACT

A marine propulsion unit of a marine vessel includes a casing provided to house the steering shaft and a controller configured or programmed to control driving of a propeller, the casing being rotatable by the steering shaft, a power supply wire to supply power to the stator, and a signal wire to transmit a drive signal to the controller. The power supply wire and the signal wire are located outside and along the casing so as to pass behind the steering shaft from a first side to a second side of the casing, the first and second sides being opposite to each other with respect to a forward-rearward direction in a plan view thereof.

20 Claims, 5 Drawing Sheets

500-500 CROSS-SECTION 510-510 CROSS-SECTION

MARINE PROPULSION UNIT AND MARINE VESSEL

CROSS REFERENCE TO RELATED APPLICATIONS

This application claims the benefit of priority to Japanese Patent Application No. 2019-236268 filed on Dec. 26, 2019. The entire contents of this application are hereby incorporated herein by reference.

BACKGROUND OF THE INVENTION

1. Field of the Invention

The present invention relates to a marine propulsion unit and a marine vessel.

2. Description of the Related Art

A marine propulsion unit is known in general. Such a marine propulsion unit is disclosed in International Publication No. 2017/082248, for example.

International Publication No. 2017/082248 discloses a marine propulsion unit including a power supply wire to supply power, a signal wire to transmit a predetermined signal, and a hollow steering shaft to steerably support a duct. The power supply wire and the signal wire are introduced into a marine propulsion unit main body by being directly inserted into the steering shaft from an upper end of the hollow steering shaft.

In the marine propulsion unit disclosed in International Publication No. 2017/082248, the power supply wire and the signal wire are directly inserted into the steering shaft. Thus, when the duct is steered about the steering shaft, it is necessary to prevent action of relatively large torsional and bending stresses on the power supply wire and the signal wire, and the steering angle of the duct is constrained.

SUMMARY OF THE INVENTION

Preferred embodiments of the present invention provide marine propulsion units and marine vessels that each significantly reduce or prevent constraints on the steering angles of ducts.

A marine propulsion unit according to a preferred embodiment of the present invention includes a duct including a stator, a propeller including a rim including a rotor that faces the stator, and a blade provided radially inwardly of the rim, a steering shaft that extends in an upward-downward direction so as to rotatably support the duct, a casing rotated by the steering shaft and provided above the duct so as to house the steering shaft and a controller configured or programmed to control driving of the propeller, a power supply wire to supply power from a power source to the stator, and a signal wire to transmit a drive signal to the controller. The power supply wire and the signal wire are located outside and along the casing so as to pass behind the steering shaft from a first side of the casing to a second side of the casing in a right-left direction.

In a marine propulsion unit according to a preferred embodiment of the present invention, the power supply wire and the signal wire are located outside and along the casing so as to pass behind the steering shaft from the first side of the casing to the second side of the casing in the right-left direction. Accordingly, the power supply wire and the signal wire are located so as to be wound around the steering shaft in an arcuate shape having a relatively small curvature (an arcuate shape having a large radius) along the casing. Furthermore, the power supply wire and the signal wire are located along the rotation direction of the steering shaft, and thus when the duct is steered about the steering shaft, the duct is steered while a state in which the power supply wire and the signal wire are wound in an arcuate shape having a relatively small curvature (an arcuate shape having a large radius) along the casing is maintained. Therefore, large torsion (deformation) of the power supply wire and the signal wire is significantly reduced or prevented during steering of the duct, and thus a constraint on the steering angle of the duct is significantly reduced or prevented. Furthermore, the power supply wire and the signal wire are located along the casing such that spaces to provide the power supply wire and the signal wire are relatively reduced. Moreover, the power supply wire and the signal wire pass behind the steering shaft, and thus entanglement of foreign matter with the power supply wire and the signal wire is significantly reduced or prevented.

In a marine propulsion unit according to a preferred embodiment of the present invention, the power supply wire and the signal wire preferably include rear ends folded back from the first side to the second side in the right-left direction above the casing. Accordingly, the power supply wire and the signal wire are installed from above with respect to the casing, and thus when the casing is steered, the power supply wire and the signal wire reliably follow movement of the casing.

In a marine propulsion unit according to a preferred embodiment of the present invention, the power supply wire and the signal wire preferably include rear ends folded back from the first side to the second side in the right-left direction rearward of a centerline of the casing in a forward-rearward direction. Accordingly, entanglement of the power supply wire and the signal wire with a structure forward of the casing is significantly reduced or prevented during steering of the duct.

In a marine propulsion unit according to a preferred embodiment of the present invention, the power supply wire and the signal wire preferably include first portions on the first side in the right-left direction, and second portions introduced into the casing on the second side in the right-left direction. Accordingly, as compared with a case in which the power supply wire and the signal wire are located on only one side in the right-left direction, the power supply wire and the signal wire have a larger arcuate shape (longer path length). Therefore, when the duct is steered about the steering shaft, the duct is steered while a state in which the power supply wire and the signal wire are wound in an arcuate shape having a relatively small curvature (an arcuate shape having a large radius) along the casing in a larger range is maintained. Consequently, large torsion (deformation) of the power supply wire and the signal wire is further significantly reduced or prevented during steering of the duct, and thus a constraint on the steering angle of the duct is further significantly reduced or prevented.

In such a case, the casing preferably includes, on the second side in the right-left direction, an introduction hole to allow the second portions to be introduced into the casing therethrough, and the second portions are preferably introduced into the introduction hole obliquely from an upper rear side toward a lower front side, as viewed in the right-left direction. Accordingly, the power supply wire and the signal wire are introduced into the introduction hole along the wiring directions when passing above the casing, and thus action of large torsional and bending stresses on the power supply wire and the signal wire is further significantly reduced or prevented.

In a marine propulsion unit according to a preferred embodiment of the present invention, the power supply wire is preferably more vulnerable to torsion and easier to bend than the signal wire, and the signal wire is preferably harder to bend and more resistant to torsion than the power supply wire. Accordingly, even when the power supply wire that is relatively vulnerable to torsion and the signal wire that is relatively hard to bend are used, action of large torsional and bending stresses on the power supply wire and the signal wire is significantly reduced or prevented. Therefore, the steerable marine propulsion unit is reliably wired.

In a marine propulsion unit according to a preferred embodiment of the present invention, the casing preferably has a streamlined shape with a rotation axis direction of the propeller as a longitudinal direction, and the power supply wire and the signal wire are preferably located along the casing having the streamlined shape such that lower ends thereof touch water. Accordingly, using up to a region in which the power supply wire and the signal wire touch water as spaces to provide the power supply wire and the signal wire, the power supply wire and the signal wire are located along the casing, and thus entanglement of foreign matter with the power supply wire and the signal wire is significantly reduced or prevented.

In a marine propulsion unit according to a preferred embodiment of the present invention, the power supply wire and the signal wire preferably include lower ends above the duct. Accordingly, obstruction of the power supply wire and the signal wire to the flow of water generated by the propeller installed in the duct 3 is prevented.

In a marine propulsion unit according to a preferred embodiment of the present invention, the power supply wire and the signal wire are preferably located along the casing while being inclined so as to be located more upward toward a rear side on which rear ends of the power supply wire and the signal wire are located. Accordingly, the power supply wire and the signal wire are located along the casing in a larger range as compared with a case in which the power supply wire and the signal wire are located only in a substantially horizontal direction or a substantially vertical direction. Therefore, action of large torsional and bending stresses on the power supply wire and the signal wire is further significantly reduced or prevented.

In a marine propulsion unit according to a preferred embodiment of the present invention, the casing preferably includes, on the second side in the right-left direction, an introduction hole to allow the power supply wire and the signal wire to be introduced into the casing therethrough, the marine propulsion unit preferably further includes, above the casing, a cowling to allow the power supply wire and the signal wire to pass therethrough, and the cowling preferably includes, on a side opposite to the introduction hole in the right-left direction, a lead-out port to lead the power supply wire and the signal wire from within the cowling toward the first side of the casing in the right-left direction. Accordingly, the power supply wire and the signal wire are led downward from the lead-out port located on the side opposite to the introduction hole in the right-left direction and above the introduction hole, and thus the power supply wire and the signal wire are easily placed along the casing while hanging down due to gravity.

In such a case, the lead-out port preferably has an elongated shape that extends in a forward-rearward direction, and the power supply wire and the signal wire are preferably moved in the forward-rearward direction inside the lead-out port along the lead-out port as the casing is rotated. Accordingly, as compared with a case in which the power supply wire and the signal wire are completely constrained by the lead-out port, torsional and bending stresses applied to the power supply wire and the signal wire during steering of the duct are reduced.

A marine propulsion unit according to a preferred embodiment of the present invention preferably further includes a restrainer to bundle the power supply wire and the signal wire at a predetermined position inside the cowling and allow the power supply wire and the signal wire to pass through the predetermined position. Accordingly, the power supply wire and the signal wire are constrained at a position spaced relatively apart from the casing to be steered. That is, the power supply wire and the signal wire are constrained at a position at which the influence of steering is relatively small. Therefore, action of large torsional and bending stresses on the power supply wire and the signal wire is further significantly reduced or prevented.

A marine propulsion unit according to a preferred embodiment of the present invention preferably further includes a trim-tilt mechanism to rotate a marine propulsion unit main body in the upward-downward direction, and the restrainer is preferably freely rotatable about an axis that extends in the right-left direction when the marine propulsion unit main body is rotated in the upward-downward direction by the trim-tilt mechanism. Accordingly, when the marine propulsion unit main body is rotated in the upward-downward direction by the trim-tilt mechanism, the restrainer is rotated to reduce torsional and bending stresses applied to the power supply wire and the signal wire.

A marine propulsion unit according to a preferred embodiment of the present invention preferably further includes a trim-tilt shaft, and the predetermined position is preferably located closer to the casing than the trim-tilt shaft. Accordingly, the power supply wire and the signal wire are constrained at a position spaced apart by an appropriate distance not too far from the casing. Thus, large movement of the power supply wire and the signal wire located along the casing is prevented during steering of the duct.

A marine vessel according to a preferred embodiment of the present invention includes a hull, and a marine propulsion unit on the hull. The marine propulsion unit includes a duct including a stator, a propeller including a rim including a rotor that faces the stator, and a blade provided radially inwardly of the rim, a steering shaft that extends in an upward-downward direction so as to rotatably support the duct, a casing rotated by the steering shaft and provided above the duct so as to house the steering shaft and a controller configured or programmed to control driving of the propeller, a power supply wire to supply power from a power source to the stator, and a signal wire to transmit a drive signal to the controller. The power supply wire and the signal wire are located outside and along the casing so as to pass behind the steering shaft from a first side of the casing to a second side of the casing in a right-left direction.

In a marine vessel according to a preferred embodiment of the present invention, the power supply wire and the signal wire are located outside and along the casing so as to pass behind the steering shaft from the first side of the casing to the second side of the casing in the right-left direction. Accordingly, a constraint on the steering angle of the duct is significantly reduced or prevented, similarly to the marine propulsion units according to preferred embodiments of the present invention described above.

In a marine vessel according to a preferred embodiment of the present invention, the power supply wire and the signal wire preferably include rear ends folded back from the first side to the second side in the right-left direction above the casing. Accordingly, the power supply wire and the signal wire are installed from above with respect to the casing, and thus when the casing is steered, the power supply wire and the signal wire reliably follow movement of the casing.

In a marine vessel according to a preferred embodiment of the present invention, the power supply wire and the signal wire preferably include rear ends folded back from the first side to the second side in the right-left direction rearward of a centerline of the casing in a forward-rearward direction. Accordingly, entanglement of the power supply wire and the signal wire with a structure forward of the casing is significantly reduced or prevented during steering of the duct.

In a marine vessel according to a preferred embodiment of the present invention, the power supply wire and the signal wire preferably include first portions on the first side in the right-left direction, and second portions introduced into the casing on the second side in the right-left direction. Accordingly, as compared with a case in which the power supply wire and the signal wire are located on only one side in the right-left direction, the power supply wire and the signal wire have a larger arcuate shape (longer path length). Therefore, when the duct is steered about the steering shaft, the duct is steered while a state in which the power supply wire and the signal wire are wound in an arcuate shape having a relatively small curvature (an arcuate shape having a large radius) along the casing in a larger range is maintained. Consequently, large torsion (deformation) of the power supply wire and the signal wire is further significantly reduced or prevented during steering of the duct, and thus a constraint on the steering angle of the duct is further significantly reduced or prevented.

In such a case, the casing preferably includes, on the second side in the right-left direction, an introduction hole to allow the second portions to be introduced into the casing therethrough, and the second portions are preferably introduced into the introduction hole obliquely from an upper rear side toward a lower front side, as viewed in the right-left direction. Accordingly, the power supply wire and the signal wire are introduced into the introduction hole along the wiring directions when passing above the casing, and thus action of large torsional and bending stresses on the power supply wire and the signal wire is further significantly reduced or prevented.

In a marine vessel according to a preferred embodiment of the present invention, the power supply wire is preferably more vulnerable to torsion and easier to bend than the signal wire, and the signal wire is preferably harder to bend and more resistant to torsion than the power supply wire. Accordingly, even when the power supply wire that is relatively vulnerable to torsion and the signal wire that is relatively hard to bend are used, action of large torsional and bending stresses on the power supply wire and the signal wire is significantly reduced or prevented. Therefore, the steerable marine propulsion unit is reliably wired.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 101 including a marine propulsion unit 100 according to preferred embodiments of the present invention is now described with reference to FIGS. 1 to 7C. In the figures, arrow FWD represents the forward movement direction of the marine vessel 101, and arrow BWD represents the reverse movement direction of the marine vessel 101. Furthermore, arrow R represents the starboard (right) direction of the marine vessel 101, and arrow L represents the portside (left) direction of the marine vessel 101. The right side (R direction) is an example of a "first side in a right-left direction", and the left side (L direction) is an example of a "second side in a right-left direction".

Figure 1:
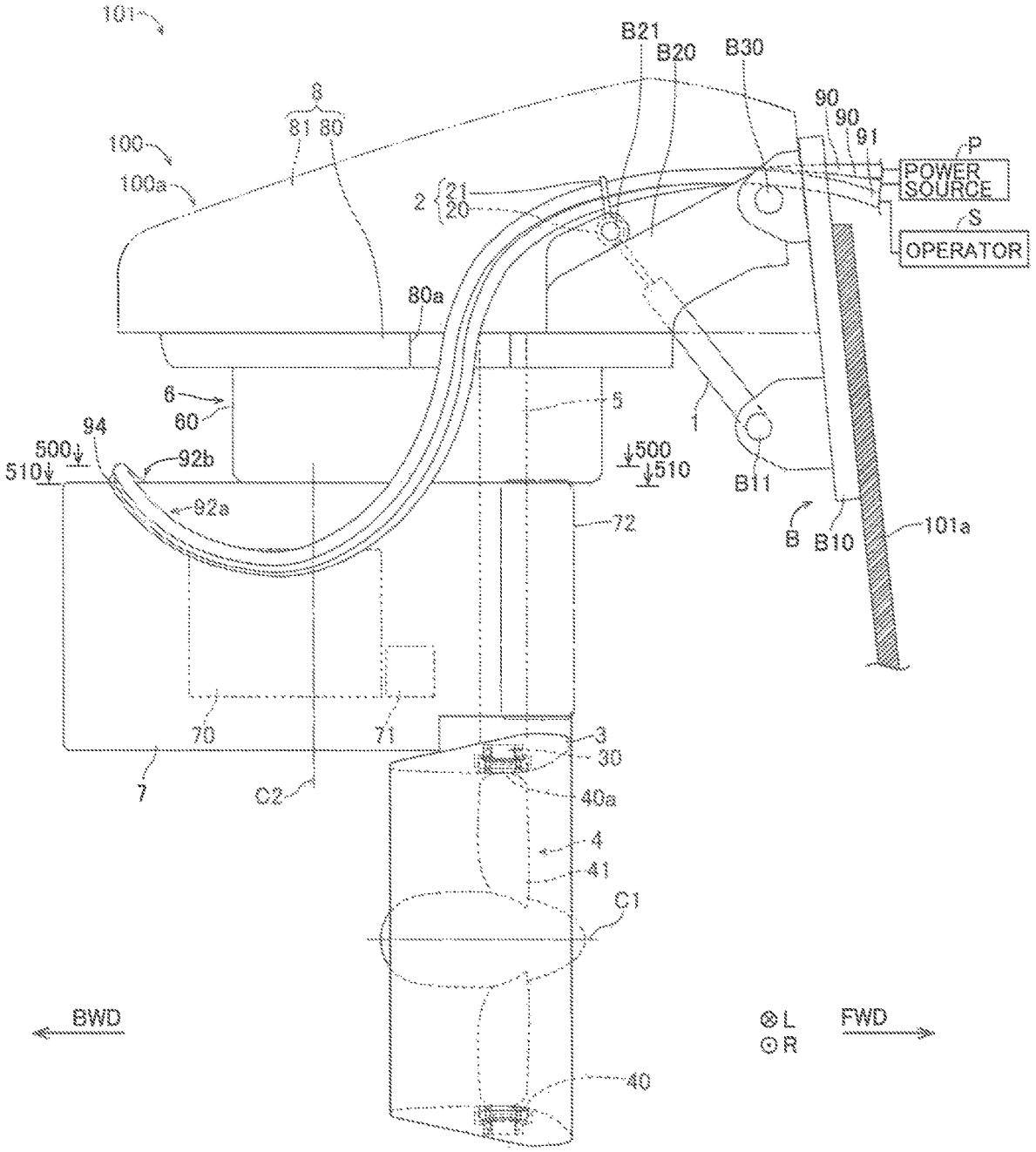
FIG. 1 is a side view showing a marine vessel including a marine propulsion unit according to a preferred embodiment of the present invention, as viewed from the right side.
Figure 2:
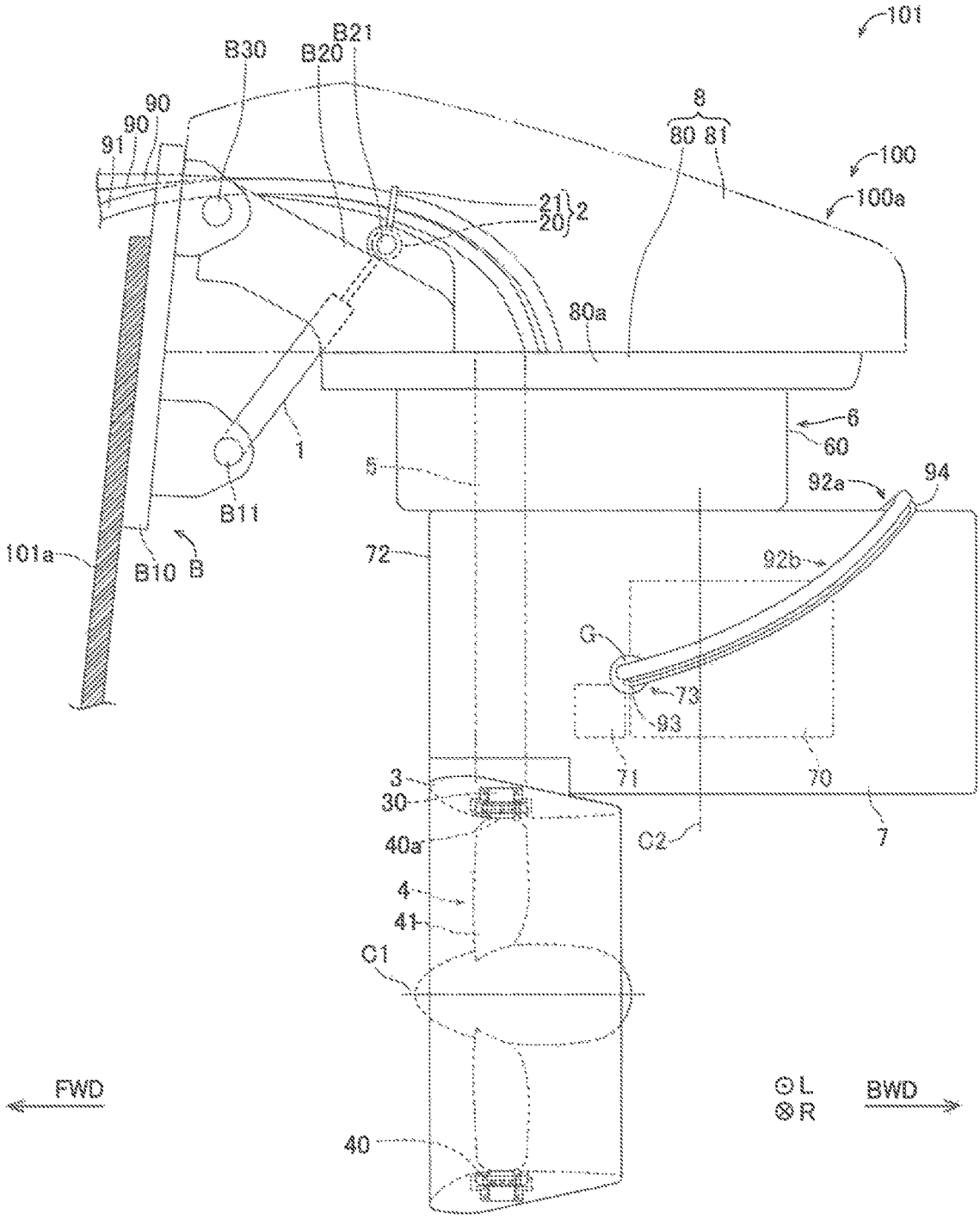
FIG. 2 is a side view showing a marine vessel including a marine propulsion unit according to a preferred embodiment of the present invention, as viewed from the left side.

As shown in FIGS. 1 and 2, the marine vessel 101 includes a hull 101*a* and the marine propulsion unit 100.

The hull 101*a* includes a power source P (battery) to supply power to the marine propulsion unit 100 via power supply wires 90, and an operator S to transmit various drive signals (control signals) to the marine propulsion unit 100 via a signal wire 91. The operator S includes a remote control and a steering wheel, for example, operated by a user.

The marine propulsion unit 100 is installed at the stern (transom) of the hull 101*a*. The marine propulsion unit 100 is driven by power supplied from the power source P via the power supply wires 90. The marine propulsion unit 100 is driven based on a drive signal transmitted from the operator S via the signal wire 91. That is, the marine propulsion unit 100 rotates and steers a propeller 4 (duct 3) based on the drive signal transmitted from the operator S via the signal wire 91, for example.

The marine propulsion unit 100 includes an electric propulsion device to propel the marine vessel 101 (hull 101*a*). The marine propulsion unit 100 includes a bracket B, a trim-tilt mechanism 1, a restrainer 2, the duct 3 including a stator 30, the propeller 4 including a rim 40 and blades 41, a steering shaft 5, a steering 6, a casing 7, a cowling 8, the power supply wires 90, and the signal wire 91. The structure of each portion of the marine propulsion unit 100 is now sequentially described.

The bracket B supports a marine propulsion unit main body 100*a*. The marine propulsion unit main body 100*a* refers to an entire structure (excluding the bracket B) rotated about a trim-tilt shaft B30 by the trim-tilt mechanism 1.

The bracket B includes a fixed bracket B10 and a movable bracket B20.

The fixed bracket B10 is fixed to the stern. The fixed bracket B10 includes the trim-tilt shaft B30 that extends in the right-left direction. The movable bracket B20 directly supports the marine propulsion unit main body 100*a*. The movable bracket B20 rotates in an upward-downward direction about the trim-tilt shaft B30 together with the marine propulsion unit main body 100*a*.

The fixed bracket B10 includes a shaft B11 that extends in the right-left direction. The shaft B11 rotatably supports a lower end of the trim-tilt mechanism 1 (cylinder).

The movable bracket B20 includes a shaft B21 that extends in the right-left direction. The shaft B21 is rotatably supported by an upper end of the trim-tilt mechanism 1 (cylinder). The shaft B21 is directly pushed up by extension of the trim-tilt mechanism 1, and is directly pushed down by contraction of the trim-tilt mechanism 1. When the shaft B21 is directly pushed up by the trim-tilt mechanism 1, the marine propulsion unit main body 100*a* is rotated upward. When the shaft B21 is directly pushed down by the trim-tilt mechanism 1, the marine propulsion unit main body 100*a* is rotated downward.

The trim-tilt mechanism 1 rotates the marine propulsion unit main body 100*a* in the upward-downward direction. The trim-tilt mechanism 1 includes a tubular cylinder including an expandable and contractable rod.

The upper end of the trim-tilt mechanism 1 rotatably supports the shaft B21, as described above. The restrainer 2 is rotatably installed on the shaft B21 side by side with the upper end of the trim-tilt mechanism 1. That is, the upper end of the trim-tilt mechanism 1 and the restrainer 2 are located adjacent to each other in the right-left direction (see FIG. 3).

The shaft B21 is located rearward of the trim-tilt shaft B30. That is, the shaft B21 is positioned closer to the casing 7 than the trim-tilt shaft B30 in a forward-rearward direction. Therefore, the restrainer 2 is positioned closer to the casing 7 than the trim-tilt mechanism 1 in the forward-rearward direction. The shaft B21 (the restrainer 2 and the upper end of the trim-tilt mechanism 1) is located inside the cowling 8.

Figure 3:
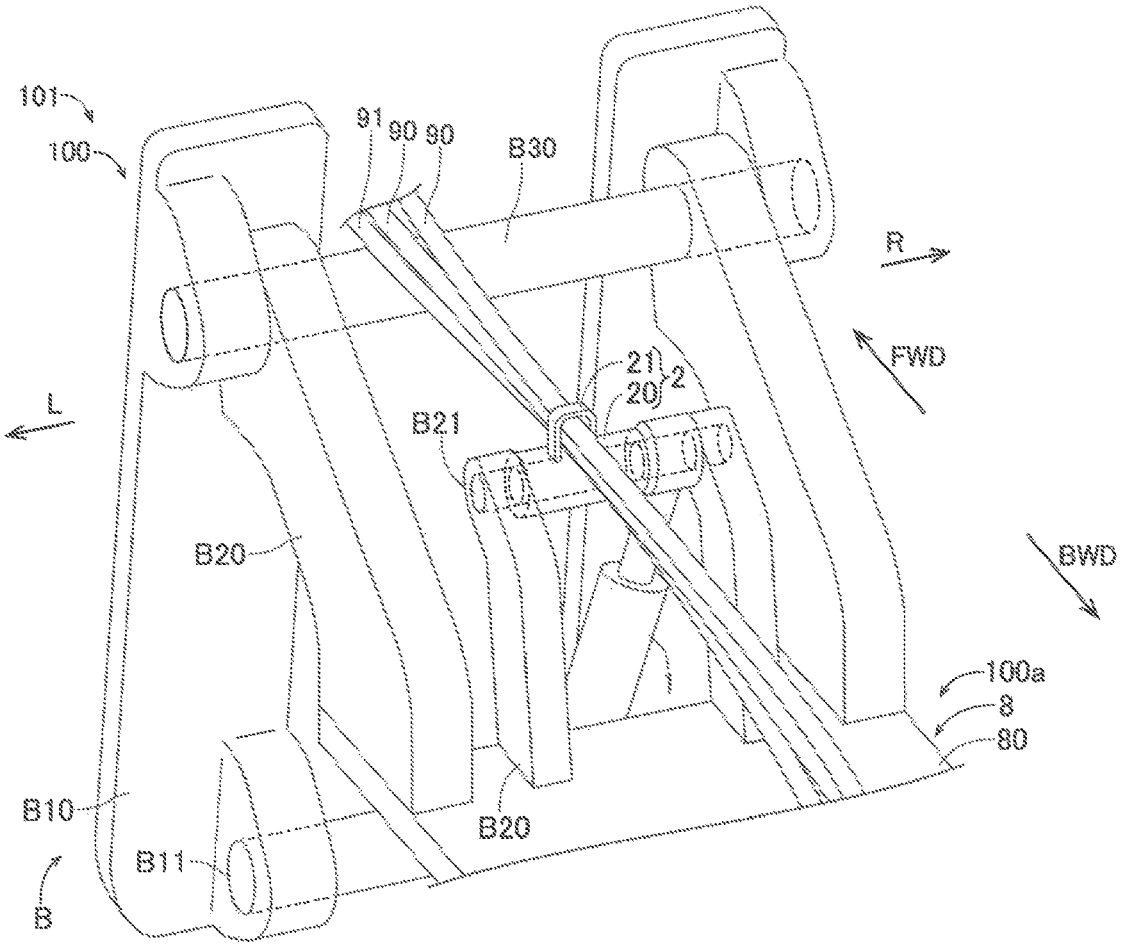
FIG. 3 is a perspective view showing power supply wires, a signal wire, a bracket, and a trim-tilt mechanism of a marine propulsion unit according to a preferred embodiment of the present invention.
Figure 4:
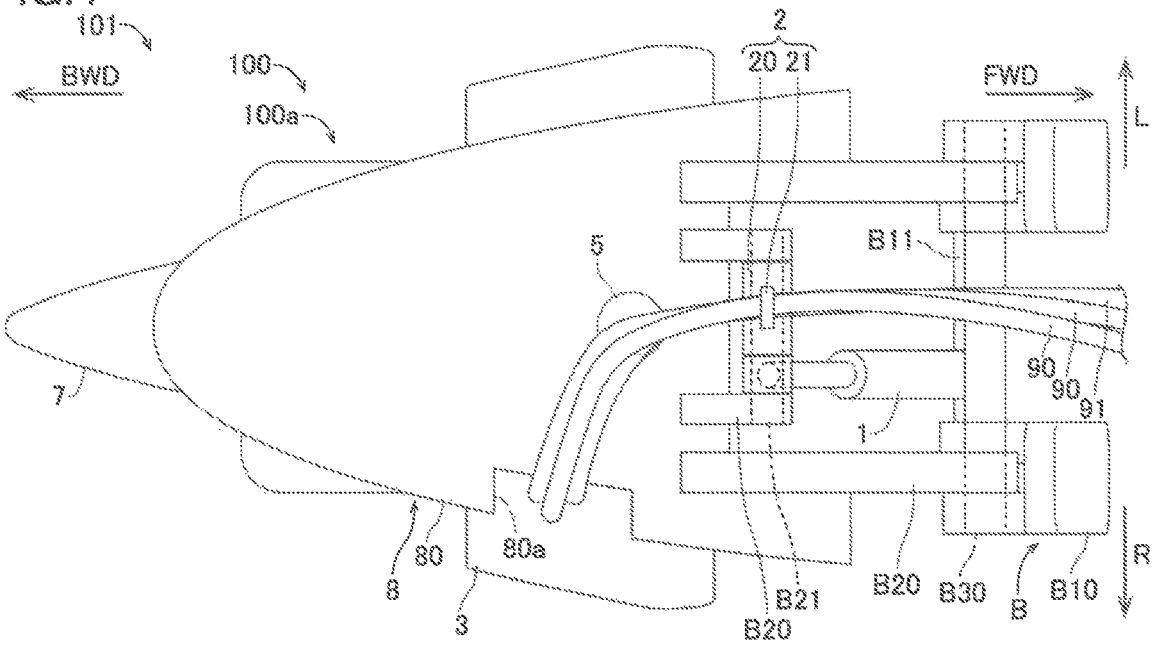
FIG. 4 is a plan view showing a marine propulsion unit according to a preferred embodiment of the present invention, as viewed from above.

As shown in FIGS. 3 and 4, the restrainer 2 includes a cylindrical portion 20 through which the shaft B21 is inserted and an annular restraining portion 21 that protrudes outward from the outer surface of the cylindrical portion 20 to bundle the power supply wires 90 and the signal wire 91.

The cylindrical portion 20 (restrainer 2) is rotatable with respect to the shaft B21. The restraining portion 21 includes a through-hole, and the power supply wires 90 and the signal wire 91 are bundled by passing through the through-hole. Therefore, the restrainer 2 bundles the power supply wires 90 and the signal wire 91 at a predetermined position inside the cowling 8 and allows the power supply wires 90 and the signal wire 91 to pass through the predetermined position. The predetermined position refers to the vicinity of the shaft B21. That is, the predetermined position is located closer to the casing 7 than the trim-tilt shaft B30. The restraining portion 21 is located above the cylindrical portion 20, and allows the power supply wires 90 and the signal wire 91 to pass therethrough above the cylindrical portion 20.

As described above, the shaft B21 is inserted through the restrainer 2, and the restrainer 2 is rotatable with respect to the shaft B21. That is, the restrainer 2 is freely rotatable about an axis (shaft B21) that extends in the right-left direction when the marine propulsion unit main body 100*a* is rotated by the trim-tilt mechanism 1.

If the restrainer 2 were fixed to the shaft B21, rear portions (portions rearward of the restrainer 2) of the power supply wires 90 and the signal wires 91 would be moved upward (downward) together with the restrainer 2 when the shaft B21 moves (rotates) upward (downward) about the trim-tilt shaft B30. Consequently, the power supply wires 90 and the signal wire 91 receive a large bending stress inside the cowling 8, and it is not preferable.

As shown in FIGS. 1 and 2, the duct 3 has a tubular shape. The duct 3 includes the stator 30. The propeller 4 is rotatably positioned radially inwardly of the tubular duct 3. The propeller 4 includes the rim 40 including a rotor 40*a* and the blades 41.

The stator 30 includes a cylindrical and annular winding that surrounds the propeller 4, and power is supplied to the winding such that a magnetic field is generated. The magnetic force of the stator 30 acts on the rotor 40*a* such that the propeller 4 is rotated. That is, the stator 30 of the duct 3 and the rotor 40*a* of the propeller 4 define an electric motor.

The rim 40 of the propeller 4 has a tubular shape and is located outside the blades 41. Furthermore, the rim 40 faces the stator 30 from the inside. The blades 41 are positioned radially inwardly of the rim 40 from the inner peripheral surface of the rim 40. The rotor 40*a* and the stator 30 face each other at a predetermined interval in the radial direction of the duct 3.

The steering shaft 5 extends in the upward-downward direction and supports the duct 3 such that the duct 3 is rotatable (steerable) in the right-left direction. Specifically, the steering shaft 5 is rotatably supported by the steering 6 via a bearing (not shown). Furthermore, the steering shaft 5 supports, via a bearing (not shown), the casing 7 that is integral and unitary with the duct 3. The steering shaft 5 is located (inserted) inside the steering 6 and the casing 7 in the order of the steering 6 and the casing 7 from the upper side to the lower side.

Figure 5:
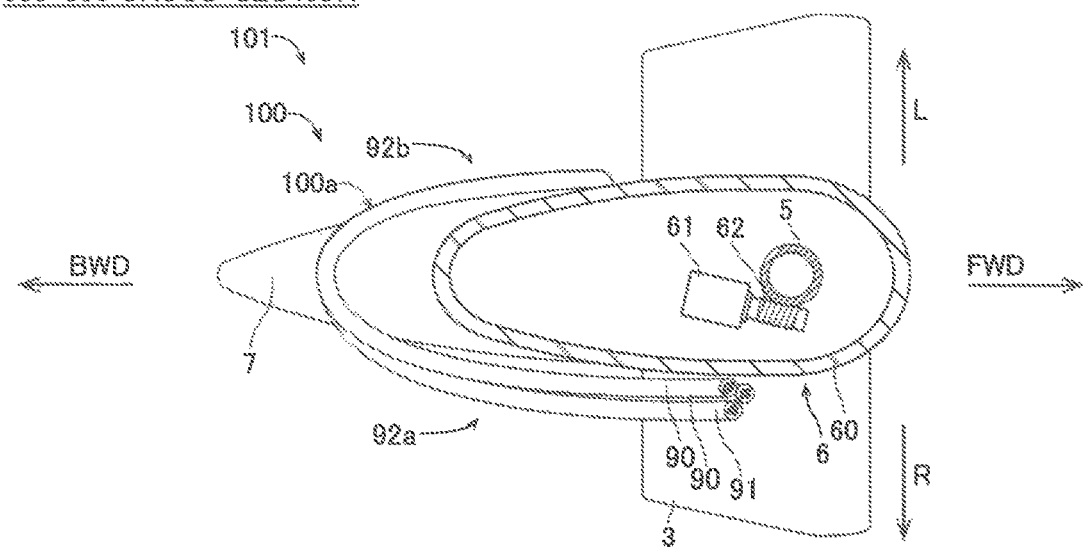
FIG. 5 is a sectional view taken along the line 500-500 in FIG. 1.

As shown in FIG. 5, the steering 6 rotates (steers) the steering shaft 5. Consequently, the steering 6 steers the duct 3 and the casing 7 together with the steering shaft 5. As an example, the steering 6 steers the duct 3 and the casing 7 together with the steering shaft 5 in a relatively large angular range of 180 degrees or more. The steering 6 includes a housing 60, and an electric motor 61 and a worm gear 62 located inside the housing 60.

The housing 60 is hollow and watertight. The housing 60 is fixed to a bottom plate 80 (see FIG. 1), which is described below, of the cowling 8 (see FIG. 1) from below. The housing 60 is located between the upper cowling 8 and the lower casing 7 in the upward-downward direction. The housing 60 is one size smaller than the cowling 8 and the bottom plate 80 in a plan view.

The electric motor 61 rotates the worm gear 62. The worm gear 62 contacts the steering shaft 5, and transmits the driving force of the electric motor 61 to the steering shaft 5 to rotate (steer) the steering shaft 5.

The casing 7 shown in FIGS. 1 and 2 is rotated by the steering shaft 5. Furthermore, the casing 7 is fixed to the duct 3 from above so as to rotate (steer) together with the duct 3. The casing 7 is hollow and watertight, and houses the steering shaft 5, a controller 70, and an AC-DC converter 71. The controller 70 includes a driver to drive the propeller 4 and the steering 6, and controls driving of the propeller 4 and the steering 6. The controller 70 controls each portion of the marine propulsion unit 100 based on various signals received via the signal wire 91. The controller 70 includes a CPU and a memory. The AC-DC converter 71 converts AC power supplied via the power supply wires 90 into DC power, and supplies the DC power to the controller 70, the stator 30, the electric motor 61, etc.

The casing 7 includes an introduction hole 73 through which second portions 92*b* described below, which are portions of the power supply wires 90 and the signal wire 91 located on the left side of the casing 7, are inserted into the casing 7. The introduction hole 73 is provided on the second side (left side) of the casing 7 in the right-left direction. In the introduction hole 73, a grommet G that keeps the inside of the casing 7 watertight is installed.

Figure 6:
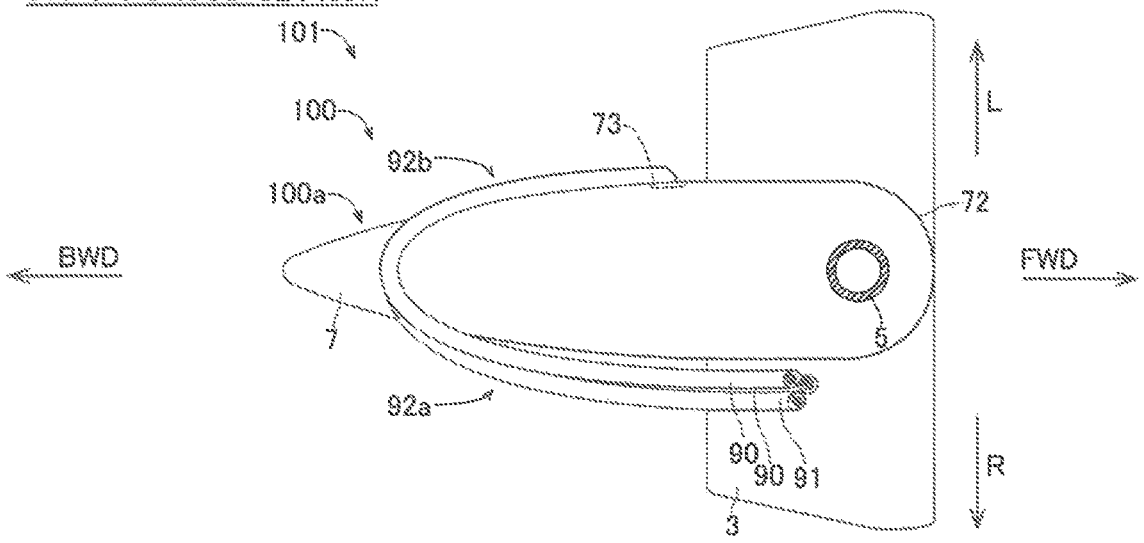
FIG. 6 is a sectional view taken along the line 510-510 in FIG. 1.

The casing 7 has a streamlined shape (fin shape) with the rotation axis direction of the propeller 4 as a longitudinal direction (see FIG. 6). That is, the casing 7 is submerged in water in the used state (i.e., the casing 7 is located at a position that contacts water), and has a shape that reduces resistance received from water during propulsion. The length of the casing 7 in the rotation axis direction of the propeller 4 is longer than the length of the casing 7 in the upward-downward direction.

The casing 7 includes a curved surface 72 that protrudes forward in a plan view (see FIG. 6). The curved surface 72 has a substantially arcuate shape that protrudes forward in the plan view. The curved surface 72 is located forward of the introduction hole 73. The introduction hole 73 is located forward of the centerline C2 of the casing 7 in the forward-rearward direction.

The cowling 8 is located above the casing 7 and the steering 6. The cowling 8 is an external component that covers a portion of the marine propulsion unit main body 100*a* above the steering 6. The power supply wires 90 and the signal wire 91 are introduced from the hull 101*a* into the cowling 8, and pass through the cowling 8. As described above, the restrainer 2 (predetermined position) is located inside the cowling 8. That is, the power supply wires 90 and the signal wire 91 are bundled inside the cowling 8.

The cowling 8 includes the bottom plate 80 that extends in a horizontal direction above the steering 6, and a cowling main body 81 (cover) on the bottom plate 80 from above. The cowling main body 81 is a member that covers various components such as the power supply wires 90 and the signal wire 91 to significantly reduce or prevent exposure thereof.

The cowling 8 (bottom plate 80) includes a lead-out port 80*a* on a side (right side) opposite to the introduction hole 73 of the casing 7 in the right-left direction. The lead-out port 80*a* leads the power supply wires 90 and the signal wire 91 from within the cowling 8 to the first side (right side) of the casing 7 in the right-left direction. The lead-out port 80*a* includes a notch at a right end of the bottom plate 80. The lead-out port 80*a* may include a through-hole at the right end of the bottom plate 80.

The lead-out port 80*a* has an elongated shape that extends in the forward-rearward direction (see FIG. 4), and is located such that the power supply wires 90 and the signal wire 91 that pass through the lead-out port 80*a* are movable in the forward-rearward direction in the lead-out port 80*a*. The lead-out port 80*a* includes a front end in the vicinity of the steering shaft 5 and a rear end rearward of the steering shaft 5 in the forward-rearward direction.

Figure 7A:
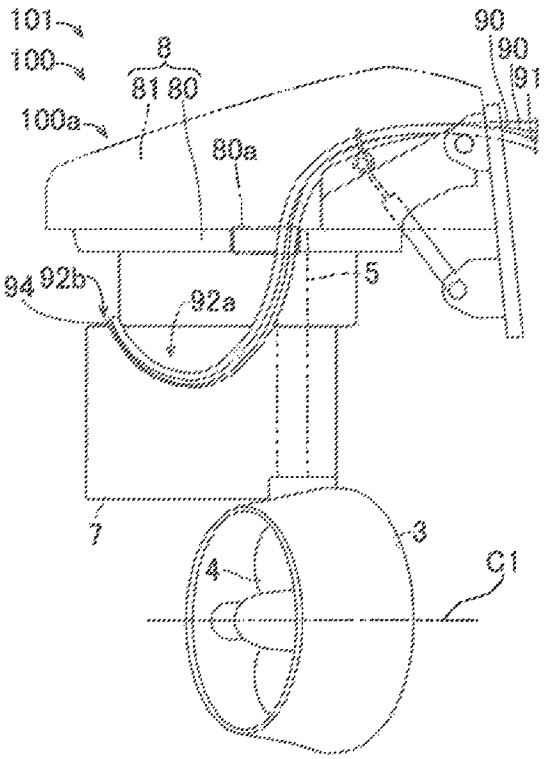
FIGS. 7A-7C are diagrams showing the states of power supply wires and a signal wire at a lead-out port of a cowling during rotation of a duct and a casing of a marine propulsion unit according to a preferred embodiment of the present invention.
Figure 7B:
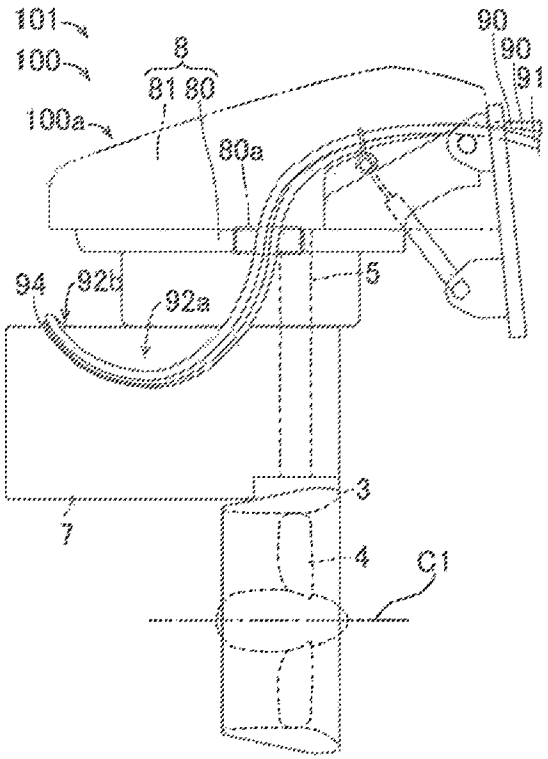
Figure 7C:
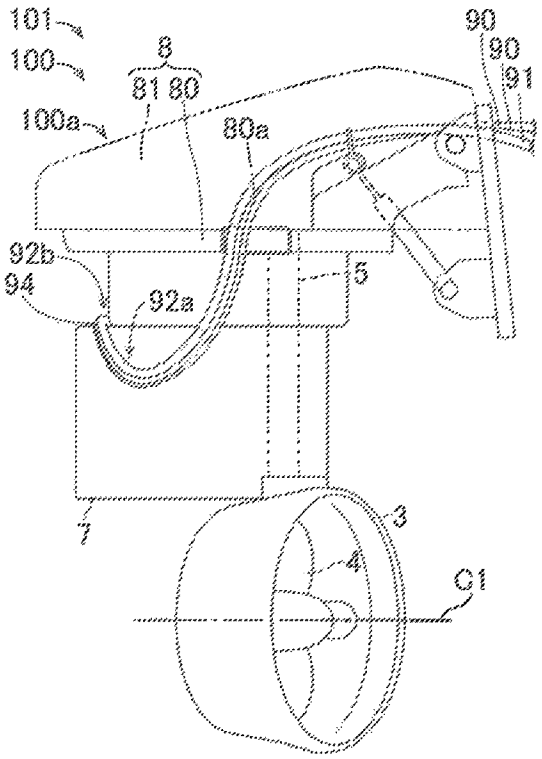

The expression "the power supply wires 90 and the signal wire 91 that pass through the lead-out port 80*a* are movable in the forward-rearward direction" indicates that the power supply wires 90 and the signal wire 91 are movable when the casing 7 (duct 3) is rotated by the steering 6. Specifically, as shown in FIG. 7A, when a rear end of the casing 7 is located on the right side, the power supply wires 90 and the signal wire 91 are located in a forward portion of the inside of the lead-out port 80*a*. When the casing 7 (duct 3) is rotated by the steering 6 such that the rear end of the casing 7 is located on the left side, the power supply wires 90 and the signal wire 91 are moved inside the lead-out port 80*a* from the front side toward the rear side, as shown in FIGS. 7B and 7C.

The lead-out port 80*a* of the cowling 8 may include a low-friction surface (not shown). The low-friction surface includes a function of preventing damage of the power supply wires 90 and the signal wire 91 due to contact (rubbing) of the power supply wires 90 and the signal wire 91 with the inner surface of the lead-out port 80*a* when the power supply wires 90 and the signal wire 91 that pass through the lead-out port 80*a* are moved in the forward-rearward direction due to steering of the duct 3. The low-friction surface may include a coating applied to the inner surface of the lead-out port 80*a*, or a friction reducing member that defines the inner surface of the lead-out port 80*a*, for example. As an example, the low-friction surface may be made of a POM resin.

If the power supply wires 90 and the signal wire 91 were restrained (not moved) in the lead-out port 80*a* of the cowling 8, the power supply wires 90 and the signal wire 91 would receive a large bending stress at the time of steering the duct 3, and it is not preferable.

As shown in FIG. 1, the power supply wires 90 supply power from the power source P mounted on the hull 101*a* to each portion of the marine propulsion unit 100 such as the controller 70, the stator 30, or the electric motor 61. The power supply wires 90 are more vulnerable to torsion and easier to bend than the signal wire 91. The power supply wires 90 include two wires of a positive electrode wire and a negative electrode wire.

The signal wire 91 transmits a drive signal from the operator S mounted on the hull 101*a* to the controller 70, for example, in the casing 7. The signal wire 91 is harder to bend and more resistant to torsion than the power supply wires 90. The signal wire 91 includes one wire. As an example, the signal wire 91 includes a cabtyre cable.

The power supply wires 90 and the signal wire 91 are located outside and along the casing 7 so as to pass behind the steering shaft 5 from the first side (right side) of the casing 7 to the second side (left side) of the casing 7 in the right-left direction. Furthermore, the power supply wires 90 and the signal wire 91 are located on the same path outside the casing 7.

Rear ends 94 of the power supply wires 90 and the signal wire 91 folded back from the first side (right side) to the second side (left side) in the right-left direction are located above the casing 7. That is, the power supply wires 90 and the signal wire 91 are folded back from the first side (right side) to the second side (left side) in the right-left direction via a position that overlaps the upper surface of the casing 7 in a plan view.

The rear ends 94 of the power supply wires 90 and the signal wire 91 folded back from the first side (right side) to the second side (left side) in the right-left direction are located rearward of the centerline C2 of the casing 7 in the forward-rearward direction. Furthermore, the rear ends 94 are located forward of the rear end of the streamlined (fin-shaped) casing 7 in the forward-rearward direction. Moreover, the rear ends 94 are located below the bottom plate 80 of the cowling 8 in the upward-downward direction.

The power supply wires 90 and the signal wire 91 are introduced from the hull 101*a* into the cowling 8, pass above the trim-tilt shaft B30, and are led out of the cowling 8 from the lead-out port 80*a* of the cowling 8 (bottom plate 80) via the restrainer 2 (predetermined position) that restrains the power supply wires 90 and the signal wire 91. The power supply wires 90 and the signal wire 91 led out of the cowling 8 from the lead-out port 80*a* are located outside (below) the cowling 8 and along the casing 7 so as to pass behind the casing 7.

As shown in FIGS. 1 and 2, first portions 92*a* of the power supply wires 90 and the signal wire 91 are located on the first side (right side) in the right-left direction, and the second portions 92*b* of the power supply wires 90 and the signal wire 91 introduced into the casing 7 are located on the second side (left side) in the right-left direction. That is, the first portions 92*a* refer to wire portions located on the first side (right side) of the casing 7 in the right-left direction. The second portions 92*b* refer to wire portions located on the second side (left side) of the casing 7 in the right-left direction. Both the first portions 92*a* and the second portions 92*b* refer to wire portions exposed below the cowling 8 and outside the casing 7.

The power supply wires 90 and the signal wire 91 are located along the casing 7 while being inclined so as to be located more upward toward the rear side on which the rear ends 94 of the power supply wires 90 and the signal wire 91 are located. That is, the power supply wires 90 and the signal wire 91 are obliquely inclined in the vicinity of the rear ends 94 such that the rear ends 94 are heightened.

The second portions 92*b* of the power supply wires 90 and the signal wire 91 are introduced into the introduction hole 73 of the casing 7 obliquely from the upper rear side toward the lower front side, as viewed in the right-left direction (from the left). That is, the power supply wires 90 and the signal wire 91 are introduced into the introduction hole 73 while maintaining the wiring directions thereof along the casing 7 so as to not receive a large bending stress in the introduction hole 73.

The power supply wires 90 and the signal wire 91 are located along the streamlined (fin-shaped) casing 7 such that lower ends 93 thereof touch water. Furthermore, the lower ends 93 are located above the duct 3. That is, the power supply wires 90 and the signal wire 91 are located at heights at which the same do not get caught in the propeller 4 and do not obstruct the flow of water generated by the propeller 4.

As described above, the power supply wires 90 and the signal wire 91 are moved in the forward-rearward direction inside the lead-out port 80*a* along the lead-out port 80*a* of the casing 7 as the casing 7 is rotated by the steering 6.

According to the various preferred embodiments of the present invention described above, the following advantageous effects are achieved.

According to a preferred embodiment of the present invention, the power supply wires 90 and the signal wire 91 are located outside and along the casing 7 so as to pass behind the steering shaft 5 from the first side of the casing 7 to the second side of the casing 7 in the right-left direction. Accordingly, the power supply wires 90 and the signal wire 91 are located so as to be wound around the steering shaft 5 in an arcuate shape having a relatively small curvature (an arcuate shape having a large radius) along the casing 7. Furthermore, the power supply wires 90 and the signal wire 91 are located along the rotation direction of the steering shaft 5, and thus when the duct 3 (casing 7) is steered about the steering shaft 5, the duct 3 (casing 7) is steered while a state in which the power supply wires 90 and the signal wire 91 are wound in an arcuate shape having a relatively small curvature (an arcuate shape having a large radius) along the casing 7 is maintained. Therefore, large torsion (deformation) of the power supply wires 90 and the signal wire 91 is significantly reduced or prevented during steering of the duct 3 (casing 7), and thus a constraint on the steering angle of the duct 3 (casing 7) is significantly reduced or prevented. Furthermore, the power supply wires 90 and the signal wire 91 are located along the casing 7 such that spaces to provide the power supply wires 90 and the signal wire 91 are relatively reduced. Moreover, the power supply wires 90 and the signal wire 91 pass behind the steering shaft 5, and thus entanglement of foreign matter with the power supply wires 90 and the signal wire 91 is significantly reduced or prevented.

According to a preferred embodiment of the present invention, the rear ends 94 of the power supply wires 90 and the signal wire 91 folded back from the first side to the second side in the right-left direction are located above the casing 7. Accordingly, the power supply wires 90 and the signal wire 91 are installed from above with respect to the casing 7, and thus when the casing 7 is steered, the power supply wires 90 and the signal wire 91 reliably follow movement of the casing 7.

According to a preferred embodiment of the present invention, the rear ends 94 of the power supply wires 90 and the signal wire 91 folded back from the first side to the second side in the right-left direction are located rearward of the centerline of the casing 7 in the forward-rearward direction. Accordingly, entanglement of the power supply wires 90 and the signal wire 91 with a structure forward of the casing 7 is significantly reduced or prevented during steering of the duct 3.

According to a preferred embodiment of the present invention, the first portions 92*a* of the power supply wires 90 and the signal wire 91 are located on the first side in the right-left direction, and the second portions 92*b* of the power supply wires 90 and the signal wire 91 introduced into the casing 7 are located on the second side in the right-left direction. Accordingly, as compared with a case in which the power supply wires 90 and the signal wire 91 are located on only one side in the right-left direction, the power supply wires 90 and the signal wire 91 have a larger arcuate shape (longer path length). Therefore, when the duct 3 is steered about the steering shaft 5, the duct 3 is steered while a state in which the power supply wires 90 and the signal wire 91 are wound in an arcuate shape having a relatively small curvature (an arcuate shape having a large radius) along the casing 7 in a larger range is maintained. Consequently, large torsion (deformation) of the power supply wires 90 and the signal wire 91 is further significantly reduced or prevented during steering of the duct 3, and thus a constraint on the steering angle of the duct 3 is further significantly reduced or prevented.

According to a preferred embodiment of the present invention, the casing 7 includes, on the second side in the right-left direction, the introduction hole 73 to allow the second portions 92*b* to be introduced into the casing 7 therethrough, and the second portions 92*b* are introduced into the introduction hole 73 obliquely from the upper rear side toward the lower front side, as viewed in the right-left direction. Accordingly, the power supply wires 90 and the signal wire 91 are introduced into the introduction hole 73 along the wiring directions when passing above the casing 7, and thus action of large torsional and bending stresses on the power supply wires 90 and the signal wire 91 is further significantly reduced or prevented.

According to a preferred embodiment of the present invention, the power supply wires 90 are more vulnerable to torsion and easier to bend than the signal wire 91, and the signal wire 91 is harder to bend and more resistant to torsion than the power supply wires 90. Accordingly, even when the power supply wires 90 that are relatively vulnerable to torsion and the signal wire 91 that is relatively hard to bend are used, action of large torsional and bending stresses on the power supply wires 90 and the signal wire 91 is significantly reduced or prevented. Therefore, the steerable marine propulsion unit 100 is reliably wired.

According to a preferred embodiment of the present invention, the casing 7 has a streamlined shape with the rotation axis direction of the propeller 4 as the longitudinal direction, and the power supply wires 90 and the signal wire 91 are located along the streamlined casing 7 such that the lower ends 93 thereof touch water. Accordingly, using up to a region in which the power supply wires 90 and the signal wire 91 touch water as spaces to provide the power supply wires 90 and the signal wire 91, the power supply wires 90 and the signal wire 91 are located along the casing 7, and thus entanglement of foreign matter with the power supply wires 90 and the signal wire 91 is significantly reduced or prevented.

According to a preferred embodiment of the present invention, the lower ends 93 of the power supply wires 90 and the signal wire 91 are located above the duct 3. Accordingly, obstruction of the power supply wires 90 and the signal wire 91 to the flow of water generated by the propeller 4 installed in the duct 3 is prevented.

According to a preferred embodiment of the present invention, the power supply wires 90 and the signal wire 91 are located along the casing 7 while being inclined so as to be located more upward toward the rear side on which the rear ends 94 of the power supply wires 90 and the signal wire 91 are located. Accordingly, the power supply wires 90 and the signal wire 91 are located along the casing 7 in a larger range as compared with a case in which the power supply wires 90 and the signal wire 91 are located only in a substantially horizontal direction or a substantially vertical direction. Therefore, action of large torsional and bending stresses on the power supply wires 90 and the signal wire 91 is further significantly reduced or prevented.

According to a preferred embodiment of the present invention, the casing 7 includes, on the second side in the right-left direction, the introduction hole 73 to allow the power supply wires 90 and the signal wire 91 to be introduced into the casing 7 therethrough, the marine propulsion unit 100 further includes, above the casing 7, the cowling 8 to allow the power supply wires 90 and the signal wire 91 to pass therethrough, and the cowling 8 includes, on the side opposite to the introduction hole 73 in the right-left direction, the lead-out port 80*a* to lead the power supply wires 90 and the signal wire 91 from within the cowling 8 to the first side of the casing 7 in the right-left direction. Accordingly, the power supply wires 90 and the signal wire 91 are led downward from the lead-out port 80*a* located on the side opposite to the introduction hole 73 in the right-left direction and above the introduction hole 73, and thus the power supply wires 90 and the signal wire 91 are easily placed along the casing 7 while hanging down due to gravity.

According to a preferred embodiment of the present invention, the lead-out port 80*a* has an elongated shape that extends in the forward-rearward direction, and the power supply wires 90 and the signal wire 91 are moved in the forward-rearward direction inside the lead-out port 80*a* along the lead-out port 80*a* as the casing 7 is rotated. Accordingly, as compared with a case in which the power supply wires 90 and the signal wire 91 are completely constrained by the lead-out port 80*a*, torsional and bending stresses applied to the power supply wires 90 and the signal wire 91 during steering of the duct 3 are reduced.

According to a preferred embodiment of the present invention, the marine propulsion unit 100 further includes the restrainer 2 to bundle the power supply wires 90 and the signal wire 91 at the predetermined position inside the cowling 8 and allow the power supply wires 90 and the signal wire 91 to pass through the predetermined position. Accordingly, the power supply wires 90 and the signal wire 91 are constrained at a position spaced relatively apart from the casing 7 to be steered. That is, the power supply wires 90 and the signal wire 91 are constrained at a position at which the influence of steering is relatively small. Therefore, action of large torsional and bending stresses on the power supply wires 90 and the signal wire 91 is further significantly reduced or prevented.

According to a preferred embodiment of the present invention, the marine propulsion unit 100 further includes the trim-tilt mechanism 1 to rotate the marine propulsion unit main body 100*a* in the upward-downward direction, and the restrainer 2 is freely rotatable about the axis that extends in the right-left direction when the marine propulsion unit main body 100*a* is rotated in the upward-downward direction by the trim-tilt mechanism 1. Accordingly, when the marine propulsion unit main body 100*a* is rotated in the upward-downward direction by the trim-tilt mechanism 1, the restrainer 2 is rotated to reduce torsional and bending stresses applied to the power supply wires 90 and the signal wire 91.

According to a preferred embodiment of the present invention, the predetermined position is located closer to the casing 7 than the trim-tilt shaft B30. Accordingly, the power supply wires 90 and the signal wire 91 are constrained at a position spaced apart by an appropriate distance not too far from the casing 7. Thus, large movement of the power supply wires 90 and the signal wire 91 located along the casing 7 is prevented during steering of the duct 3.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the marine propulsion unit preferably includes the trim-tilt mechanism in preferred embodiments described above, the present invention is not restricted to this. In the present invention, the marine propulsion unit may not include the trim-tilt mechanism.

While the marine propulsion unit preferably includes only one signal wire in preferred embodiments described above, the present invention is not restricted to this. In the present invention, the marine propulsion unit may alternatively include a plurality of signal wires.

While the power supply wires and the signal wire are preferably introduced into the casing from the introduction hole on the left side of the casing of the marine propulsion unit in preferred embodiments described above, the present invention is not restricted to this. In the present invention, the introduction hole may alternatively be provided on the right side of the casing of the marine propulsion unit, and the power supply wires and the signal wire may alternatively be introduced into the casing from the introduction hole on the right side. In such a case, the lead-out port is provided on the left side of the cowling.

While the introduction hole is preferably provided in a portion of the casing rearward of the curved surface in preferred embodiments described above, the present invention is not restricted to this. In the present invention, the introduction hole may alternatively be provided on the curved surface of the casing.

While the lower ends of the power supply wires and the signal wire of the marine propulsion unit preferably touch water in preferred embodiments described above, the present invention is not restricted to this. In the present invention, the lower ends of the power supply wires and the signal wire may alternatively be covered with a cover so as to not touch water.

While the casing of the marine propulsion unit preferably has a streamlined shape in preferred embodiments described above, the present invention is not restricted to this. In the present invention, the casing of the marine propulsion unit may alternatively have a shape other than a streamlined shape such as an elliptical shape.

While the predetermined position at which the power supply wires and the signal wire are bundled by the restrainer is preferably located closer to the casing than the trim-tilt shaft in preferred embodiments described above, the present invention is not restricted to this. In the present invention, the predetermined position at which the power supply wires and the signal wire are bundled by the restrainer may alternatively be located in the trim-tilt shaft or on the hull side relative to the trim-tilt shaft.

While the restrainer preferably includes the cylindrical portion and the annular restraining portion in preferred embodiments described above, the present invention is not restricted to this. In the present invention, the restrainer may alternatively include a string-shaped member, for example.

While the power supply wires and the signal wire are preferably moved in the forward-rearward direction inside the lead-out port as the casing is rotated in preferred embodiments described above, the present invention is not restricted to this. In the present invention, the power supply wires and the signal wire may alternatively be constrained in the lead-out port so as to not be moved inside the lead-out port as the casing is rotated.

While the power supply wires and the signal wire are preferably located along the casing from the first side of the casing to the second side of the casing in the right-left direction via above the casing in preferred embodiments described above, the present invention is not restricted to this. In the present invention, the power supply wires and the signal wire may alternatively be located along the casing from the first side of the casing to the second side of the casing in the right-left direction via behind the casing.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion unit of a marine vessel, comprising:

a duct including a stator;

a propeller including a rim including a rotor, the rotor facing the stator, and a blade provided radially inwardly of the rim;

a steering shaft that extends in an upward-downward direction of the marine vessel, and is rotatably connected to the duct;

a casing provided above the duct to house the steering shaft and a controller configured or programmed to control driving of the propeller, the casing being rotatable by the steering shaft;

a power supply wire to supply power to the stator; and a signal wire to transmit a drive signal to the controller; wherein the power supply wire and the signal wire are located outside and along the casing so as to pass behind the steering shaft from a first side of the casing to a second side of the casing in contact with a top of the casing, the first and second sides being opposite to each other with respect to a right-left direction of the marine vessel in a plan view thereof.

2. The marine propulsion unit according to claim 1, wherein each of the power supply wire and the signal wire includes a rear end that is folded back from the first side of the casing to the second side thereof above the casing.

3. The marine propulsion unit according to claim 1, wherein each of the power supply wire and the signal wire includes a rear end that is folded back from the first side of the casing to the second side thereof, at a position rearward of, in a forward-rearward direction of the marine vessel, a centerline of the casing.

4. The marine propulsion unit according to claim 1, wherein each of the power supply wire and the signal wire includes a first portion thereof on the first side of the casing, and a second portion thereof on the second side of the casing, the second portion being introduced into the casing on the second side thereof.

5. The marine propulsion unit according to claim 4, wherein the casing includes, on the second side thereof, an introduction hole, through which the second portion of the power supply wire and the second portion of the signal wire are introduced into the casing; and the second portions of the power supply wire and the signal wire are introduced into the introduction hole obliquely from an upper rear side of the marine vessel toward a lower front side of the marine vessel, as viewed in the right-left direction.

6. The marine propulsion unit according to claim 1, wherein the signal wire is harder to bend and more resistant to torsion than the power supply wire.

7. The marine propulsion unit according to claim 1, wherein the casing has a streamlined shape, a longitudinal direction of which is a rotation axis direction of the propeller; and the power supply wire and the signal wire are located along the casing having the streamlined shape such that lower ends thereof touch water.

8. The marine propulsion unit according to claim 1, wherein each of the power supply wire and the signal wire includes a lower end thereof above the duct in the upward-downward direction of the marine vessel.

9. The marine propulsion unit according to claim 1, wherein the power supply wire and the signal wire are located along the casing and are upwardly inclined with respect to a rearward direction of the marine vessel in which rear ends of the power supply wire and the signal wire are located.

10. The marine propulsion unit according to claim 1, wherein the casing includes, on the second side thereof, an introduction hole, through which the power supply wire and the signal wire are introduced into the casing;

the marine propulsion unit further includes, above the casing in the upward-downward direction of the marine vessel, a cowling to allow the power supply wire and the signal wire to pass therethrough; and the cowling includes a lead-out port to lead the power supply wire and the signal wire from within the cowling toward the first side of the casing, the lead-out port and the introduction hole being on opposite sides with respect to a forward-rearward direction of the marine vessel in the plan view thereof.

11. The marine propulsion unit according to claim 10, wherein the lead-out port has an elongated shape that extends in the forward-rearward direction of the marine vessel; and the power supply wire and the signal wire are movable in the forward-rearward direction inside the lead-out port as the casing is rotated.

12. The marine propulsion unit according to claim 10, further comprising:

a restrainer that bundles the power supply wire and the signal wire passing therethrough at a predetermined position inside the cowling.

13. The marine propulsion unit according to claim 12, further comprising:

a trim-tilt mechanism that rotates a main body of the marine propulsion unit in the upward-downward direction of the marine vessel; wherein the restrainer is freely rotatable about an axis that extends in the right-left direction of the marine vessel when the main body of the marine propulsion unit is rotated in the upward-downward direction by the trim-tilt mechanism.

14. The marine propulsion unit according to claim 13, further comprising:

a trim-tilt shaft; wherein the predetermined position is located closer to the casing than the trim-tilt shaft.

15. A marine vessel comprising:

a hull; and a marine propulsion unit on the hull, the marine propulsion unit including:

a duct including a stator;

a propeller including a rim including a rotor, the rotor facing the stator, and a blade provided radially inwardly of the rim;

a steering shaft that extends in an upward-downward direction of the marine vessel, and is rotatably connected to the duct;

a casing provided above the duct to house the steering shaft and a controller configured or programmed to control driving of the propeller, the casing being rotatable by the steering shaft;

a power supply wire to supply power to the stator; and a signal wire to transmit a drive signal to the controller, wherein the power supply wire and the signal wire are located outside and along the casing so as to pass behind the steering shaft from a first side of the casing to a second side of the casing in contact with a top of the casing, the first and second sides being opposite to each other with respect to a right-left direction of the marine vessel in a plan view thereof.

16. The marine vessel according to claim 15, wherein each of the power supply wire and the signal wire includes a rear end thereof that is folded back from the first side of the casing to the second side thereof above the casing.

17. The marine vessel according to claim 15, wherein each of the power supply wire and the signal wire includes a rear end thereof that is folded back from the first side of the casing to the second side thereof, at a position rearward of, in a forward-rearward direction of the marine vessel, a centerline of the casing.

18. The marine vessel according to claim 15, wherein each of the power supply wire and the signal wire includes a first portion thereof on the first side of the casing, and a second portion thereof on the second side of the casing, the second portion being introduced into the casing on the second side thereof.

19. The marine vessel according to claim 18, wherein the casing includes, on the second side thereof, an introduction hole, through which the second portion of the power supply wire and the second portion of the signal wire are introduced into the casing; and the second portions of the power supply wire and the signal wire are introduced into the introduction hole obliquely from an upper rear side of the marine vessel toward a lower front side of the marine vessel.

20. The marine vessel according to claim 15, wherein the signal wire is harder to bend and more resistant to torsion than the power supply wire.

* * * * *